US006308367B1

(12) United States Patent
Beals et al.

(10) Patent No.: US 6,308,367 B1
(45) Date of Patent: Oct. 30, 2001

(54) TOOTHBRUSH

(75) Inventors: Donna Beals, Sunnyville; Maisie Wong-Paredes, Redwood Shores; Craig Masterman, Foster City, all of CA (US); Michael Roberts, Braintree, MA (US); Bradley Castillo, San Ramon, CA (US)

(73) Assignee: Gillette Canada Company (CA)

( * ) Notice: Subject to any disclaimer, the term of this patent is extended or adjusted under 35 U.S.C. 154(b) by 0 days.

(21) Appl. No.: 09/177,991

(22) Filed: Oct. 23, 1998

Related U.S. Application Data

(63) Continuation-in-part of application No. 08/968,293, filed on Nov. 12, 1997, now abandoned.

(51) Int. Cl.[7] ..... A46B 9/04

(52) U.S. Cl. ..... 15/167.1; 15/DIG. 5

(58) Field of Search ..... 15/167.1, DIG. 5, 15/DIG. 6; D4/104, 105, 106, 107, 110

(56) References Cited

U.S. PATENT DOCUMENTS

| | | | |
|---|---|---|---|
| Re. 19,006 | 11/1933 | Graves . | |
| D. 289,703 | 5/1987 | Yaffe | D4/104 |
| D. 329,946 | 10/1992 | Curtis et al. . | |
| D. 329,947 | 10/1992 | Curtis et al. . | |
| D. 330,286 | 10/1992 | Curtis et al. . | |
| D. 334,288 | 3/1993 | Witzig-Jaggi . | |
| 335,345 | 2/1886 | Estabrook . | |
| D. 349,605 | 8/1994 | Schneider et al. . | |
| D. 358,032 | 5/1995 | Schneider et al. . | |
| D. 358,486 | 5/1995 | Loew . | |
| D. 363,373 | 10/1995 | Heinzelman et al. | D4/104 |
| D. 365,209 | 12/1995 | Plummer | D4/104 |
| D. 368,804 | 4/1996 | Yost et al. . | |
| D. 370,564 | 6/1996 | Moskovich | D4/104 |
| D. 372,584 | 8/1996 | Yost et al. . | |
| D. 373,681 | 9/1996 | Yost et al. . | |
| D. 374,122 | 10/1996 | Yost et al. . | |

(List continued on next page.)

FOREIGN PATENT DOCUMENTS

| | | | |
|---|---|---|---|
| 454913 | | 3/1949 | (CA) . |
| 324623 | | 11/1957 | (CH) . |
| 919224 | | 10/1954 | (DE) . |
| GM 1857519 | | 6/1962 | (DE) . |
| GM 1905029 | | 6/1964 | (DE) . |
| 44 12 301 C2 | | 5/1996 | (DE) . |
| 0885573A1 | | 12/1998 | (EP) . |
| 2624360 | | 6/1916 | (FR) . |
| 683311 | | 6/1930 | (FR) . |
| 2 331 981 | | 6/1976 | (FR) . |
| 0017666 | | of 1896 | (GB) . |
| 946283 | | 1/1964 | (GB) . |
| 338100 | * | 9/1936 | (IT) . |
| 260913 | | 10/1995 | (JP) . |
| 8500178 | | 8/1986 | (NL) . |
| 1752336 | * | 8/1992 | (SU) . |
| 211672 | | 8/1993 | (TW) . |
| 94/09678 | | 5/1994 | (WO) . |
| 31917 | * | 11/1995 | (WO) . |
| WO 96/02165 | | 2/1996 | (WO) . |
| 15696 | * | 5/1996 | (WO) . |

*Primary Examiner*—Robert J. Warden, Sr.
*Assistant Examiner*—Kaj K. Olsen
(74) *Attorney, Agent, or Firm*—David A. Howley

(57) ABSTRACT

A toothbrush having a handle a head extending from the handle, and a plurality of tufts of bristles secured to the head. One of the tufts is secured to the head at a location such that no other tuft is secured to the head at a location which is more distal from the handle than the location where the one tuft is secured to the head. The one tuft is angled by about 81 degrees or less relative to an imaginary line which is tangent to or co-planar with a surface of the head through which the one tuft is secured to the head. The one tuft is tilted away from the handle towards a direction along which the head extends from the handle.

35 Claims, 4 Drawing Sheets

U.S. PATENT DOCUMENTS

| | | | | |
|---|---|---|---|---|
| D. 374,350 | | 10/1996 | Yost et al. . | |
| D. 374,775 | | 10/1996 | Yost et al. . | |
| D. 402,116 | * | 12/1998 | Magloff et al. | D4/104 |
| D. 405,612 | * | 2/1999 | Swanson | D4/104 |
| 669,402 | | 3/1901 | Rose . | |
| 1,018,927 | | 2/1912 | Sarrazin . | |
| 1,753,290 | | 4/1930 | Graves . | |
| 2,139,245 | | 12/1938 | Ogden | 128/62 |
| 2,242,743 | | 5/1941 | Brown . | |
| 3,085,273 | | 4/1963 | Cowan . | |
| 3,230,562 | | 1/1966 | Birch | 15/110 |
| 3,375,820 | | 4/1968 | Kuris et al. | 128/62 |
| 3,378,870 | | 4/1968 | Matsunaga . | |
| 3,624,667 | | 11/1971 | Muhler . | |
| 3,722,020 | | 3/1973 | Hills . | |
| 4,010,509 | | 3/1977 | Huish | 15/167 R |
| 4,081,876 | | 4/1978 | Pugh . | |
| 4,167,794 | | 9/1979 | Pomeroy | 15/188 |
| 4,268,933 | | 5/1981 | Papas | 15/167 |
| 4,646,381 | | 3/1987 | Weihrauch . | |
| 4,706,322 | | 11/1987 | Nicolas . | |
| 4,776,054 | | 10/1988 | Rauch | 15/167.1 |
| 4,802,255 | | 2/1989 | Breuer et al. . | |
| 4,852,202 | | 8/1989 | Ledwitz . | |
| 5,046,213 | | 9/1991 | Curtis et al. . | |
| 5,257,434 | | 11/1993 | Nabetani | 15/167.1 |
| 5,325,560 | | 7/1994 | Pavone | 15/106 |
| 5,392,483 | | 2/1995 | Heinzelman | 15/167.1 |
| 5,398,368 | | 3/1995 | Elder | 15/167.1 |
| 5,446,940 | | 9/1995 | Curtis et al. . | |
| 5,459,889 | | 10/1995 | Bauer | 15/167.1 |
| 5,511,275 | * | 4/1996 | Volpenhein et al. | 15/167.1 |
| 5,622,502 | | 4/1997 | Wilkes et al. . | |
| 5,628,082 | | 5/1997 | Moskovich . | |
| 5,735,298 | | 4/1998 | Mayne et al. . | |
| 5,742,972 | | 4/1998 | Bredall et al. . | |
| 5,802,656 | | 9/1998 | Dawson et al. | 15/110 |
| 5,926,898 | | 7/1999 | Kramer . | |
| 5,930,860 | * | 8/1999 | Shipp | 15/110 |

* cited by examiner

TOOTHBRUSH

This application is a continuation in part of U.S. patent application Ser. No. 08/968,293 filed on Nov. 12, 1997 now abandoned.

FIELD OF THE INVENTION

The invention relates generally to the field of oral care, and in particular to toothbrushes. More particularly, the invention relates to a toothbrushes with a three-dimensional bristle profile to provide improved cleaning of interproximal and gingival marginal regions of teeth.

BACKGROUND OF THE INVENTION

Toothbrushing and flossing are fundamental steps in achieving good oral hygiene. The practice of flossing, unfortunately, has not met with widespread acceptance among the general populace even though it is acknowledged by the general populace that flossing is something that should be completed as part of good oral hygiene. Furthermore, even people who floss oftentimes do not perform adequate flossing in hard to reach areas of the mouth. Unfortunately, while most commercially available toothbrushes clean the outer buccal face of teeth adequately, they fail to provide improved cleaning of plaque and debris from the gingival margin, interproximal areas, lingual surfaces and other hard to reach areas of the mouth.

One reason that such toothbrushes do not adequately clean the rear-most molars (e.g. wisdom teeth or second molars) is that the one or more tufts secured to the toothbrush head at a location most distal from the toothbrush handle are not angled towards a direction along which the head extends from the handle. As such, these tufts cannot extend far enough past the end of the head of the toothbrush to sufficiently clean the molar teeth in the back of the mouth.

Additionally, in those brushes having tufts of bristles which angle towards the handle and other tufts which angle away from the handle, all of such tufts are essentially the same length and have the same cross-section. Consequently, while these angled tufts may clean one part of the teeth in a satisfactory manner, other parts of the teeth will not be cleaned sufficiently due to the homogeneous length, spacing and cross-section of the tufts.

Further, prior art toothbrushes disclose tufts of bristles having at most three different types of cross-sections. However, there are more than three parts of the teeth which need to be cleaned by a brush (e.g. the outer buccal face, gingival margin, interproximal areas, lingual surfaces and rearward most molars). As such, prior art brushes do not provide tufts of sufficiently varied cross-section specifically designed to clean all areas of the teeth.

SUMMARY OF THE INVENTION

The present invention is directed to overcoming one or more of the problems set forth above. Briefly summarized, according to one aspect of the present invention, a toothbrush includes a handle, a head extending from the handle, and a plurality of tufts of bristles secured to the head. One of the tufts is secured to the head at a location such that no other tuft is secured to the head at a location which is more distal from the handle than the location where the one tuft is secured to the head. The one tuft is angled by about 81 degrees or less relative to an imaginary line which is tangent to or co-planar with a surface of the head through which the one tuft is secured to the head. The one tuft is tilted away from the handle towards a direction along which the head extends from the handle.

By angling the one tuft as described in the previous paragraph, the tuft is able to extend past the end of the head of the toothbrush and thus clean molars in the back of the mouth in a more sufficient manner.

According to another aspect of the invention, a toothbrush includes a handle, a head extending from the handle, and a plurality of tufts of bristles secured to the head. Two of the tufts are each at an acute angle relative to an imaginary line which is tangent to or co-planar with a surface of the head through which the two tufts are secured to the head. The two tufts have a different characteristic from each other selected from the group of characteristics consisting of length, cross-section, color, material and combinations thereof.

Providing angled tufts which vary in their length, cross-section, color, materials or combinations thereof, allows such angled tufts to clean more than one part of the teeth. For example, one type of angled tuft will clean the buccal face of teeth while another type of angled tuft will clean the interproximal areas of the teeth.

According to a third aspect of the invention, a toothbrush includes a handle, a head extending from the handle, and, a multiplicity of tufts of bristles secured to the head. The multiplicity of tufts include tufts with at least five different types of cross-sections.

By providing tufts with at least five types of cross-sections, these tufts can clean all areas of the teeth (e.g. the outer buccal face, gingival margin, interproximal areas, lingual surfaces and rearward most molars) properly.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE INVENTION

Figure 1:
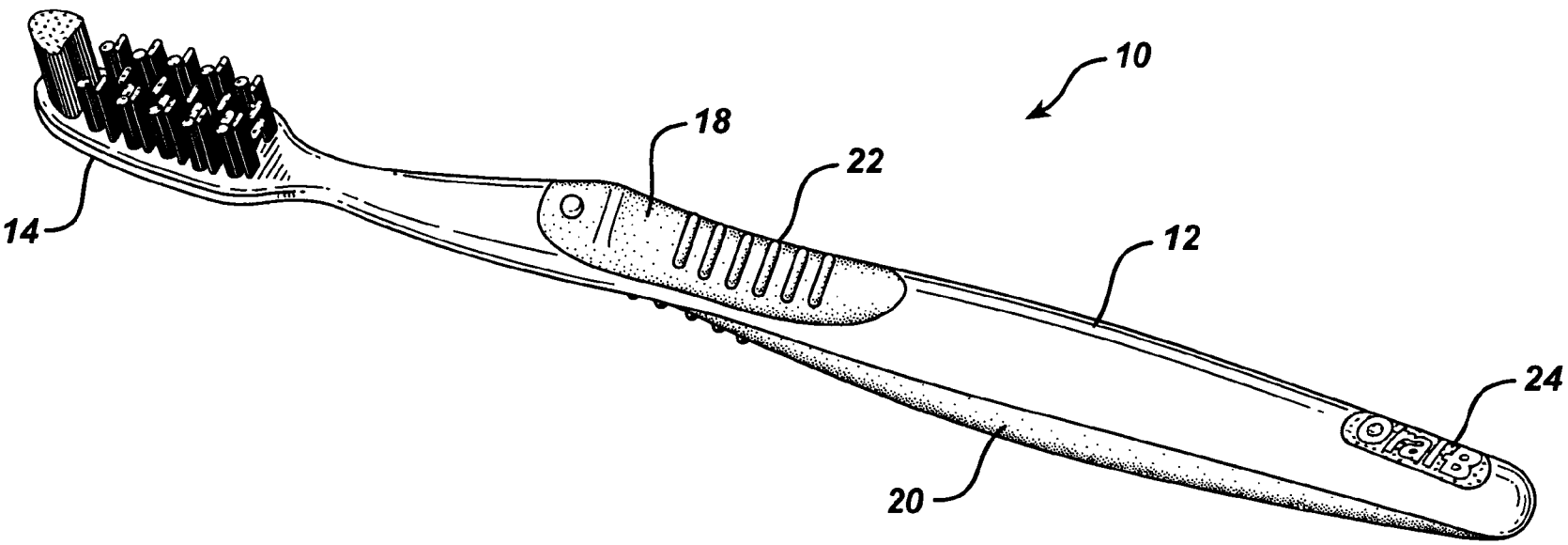
FIG. 1 is a perspective view of a toothbrush according to the present invention.
Figure 2:
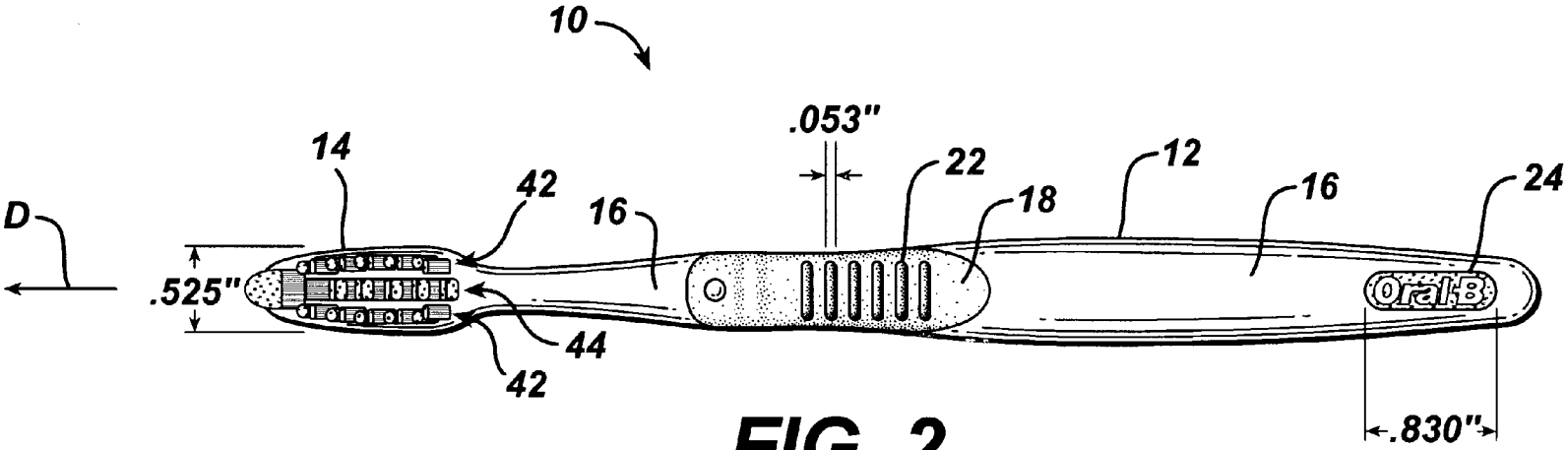
FIG. 2 is a top view of the toothbrush of FIG. 1.
Figure 3:
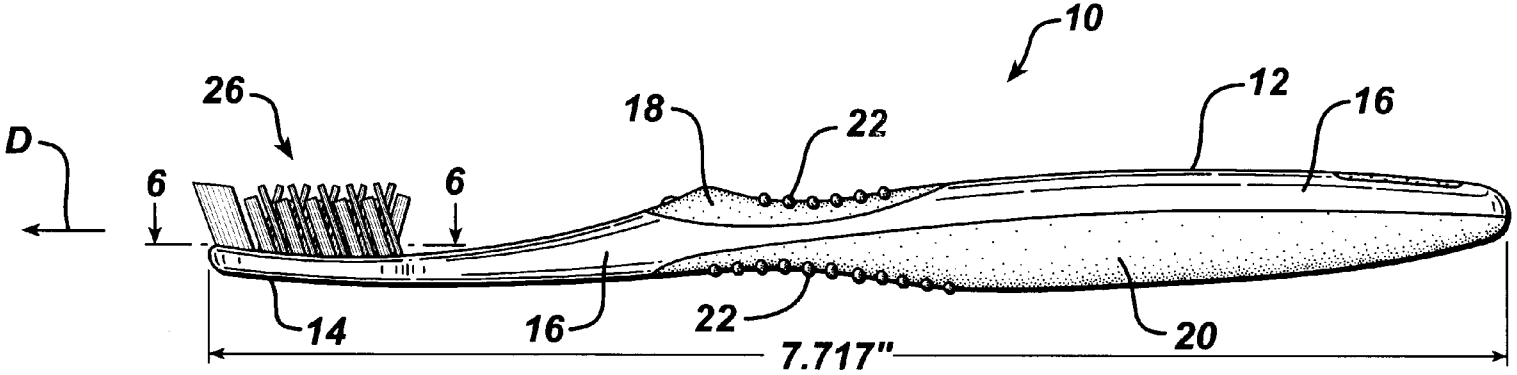
FIG. 3 is a side view of the toothbrush of FIG. 1

Beginning with FIGS. 1–3, a toothbrush 10 includes a handle portion 12 and a head portion 14 which extends from the handle in a direction D. The overall length of toothbrush 10 is preferably about 7.7 inches while the width of head 14 at its widest portion is preferably about 0.5 inches. A main portion 16 of handle 12, and head 14 are made of a unitary piece of polypropylene. Remaining portions of handle 12, including thumb gripping portion 18, optional Trademark 24 (preferably about 0.83 inches long) and finger gripping portion 20 are preferably made of a thermoplastic elastomer, preferably kraton rubber (a hydrogenated or unhydrogenated oil filled block co-polymer of styrene and butadiene or isoprene having a shore A hardness of between about 5 and about 70). Thumb gripping portion 18 and a portion of finger gripping portion 20 have a series of seventeen raised ribs 22 which aid in the gripability of the handle. Ribs 22 are preferably 0.05 inches in width.

With reference to FIGS. 3–7, a plurality of tufts 26 of bristles are secured to head 14 of the toothbrush. Each tuft is made up of a large number of bristles, and all of the bristles are preferably end-rounded. There are five different types of tufts secured to the head each tuft type having a cross-section which differs in both area and shape to the other tuft types.

A first type of tuft, type 28, is made up of bristles formed of polybutylene-terephthalate (PBT) with an abrasive such as kaolin clay particles mixed throughout the PBT. These bristles are between about 0.005 to 0.009 inches in diameter, preferably 0.007 inches in diameter. The length of these bristles, measured from surface 30 of head 14, is about 0.440 inches. The cross-sectional tufted area for tuft 28 is about 0.0373 square inches, providing a tuft volume measured from the head surface of about 0.0164 cubic inches (preferably this volume is between about 0.015 and 0.018 cubic inches). There is only one type 28 tuft secured to head 14 and it is located more distal from handle 14 than any other tuft.

Figure 6:
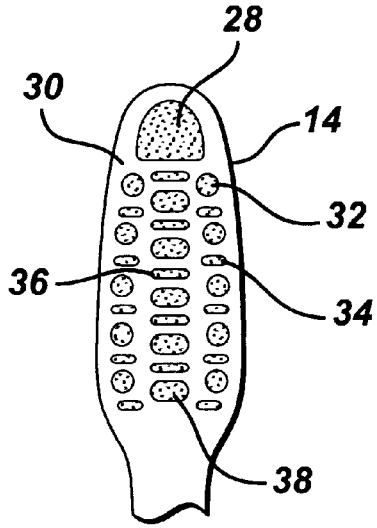
FIG. 6 is a partial sectional view of the head of the toothbrush taken along the lines of 6—6 of FIG. 3.
Figure 7:
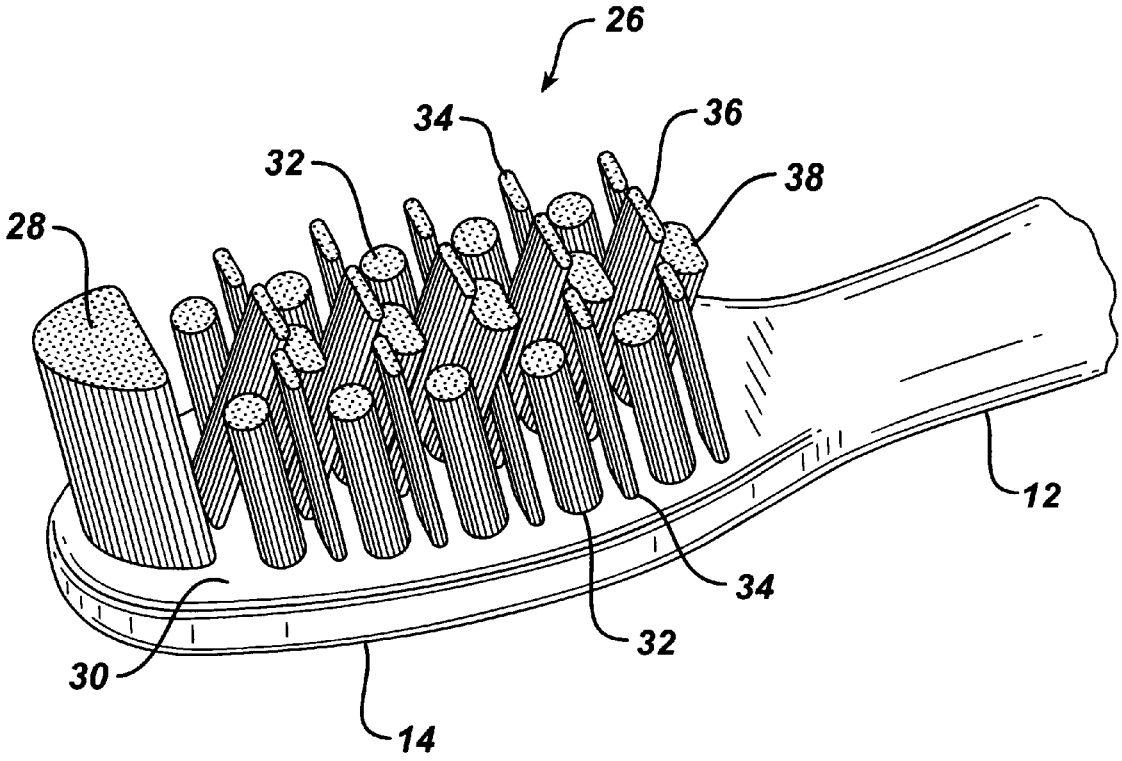
FIG. 7 perspective view of the head and a portion of the handle of the toothbrush of FIG. 1.

A second type of tuft, type 32, is made up of nylon Indicator™ type bristles which are formed of 6.12 nylon and colored blue on their external surface. As is well known in the art, the blue coloring on these bristles is slowly worn away as the brush is used over time to indicate the extent to which the toothbrush is worn. These bristles are between about 0.005 to 0.009 inches in diameter, preferably 0.007 inches in diameter. The length of these bristles, measured from surface 30 of head 14, is about 0.350 inches. The cross-sectional area of each tuft 32 is about 0.0045 square inches. As shown in FIG. 6, type 32 tufts have a round cross-section. There are between 8 and 12 type 32 tufts secured to head 14.

A third type of tuft, type 34, is made up of bristles formed of PBT with an abrasive such as kaolin clay particles mixed throughout the PBT. These bristles are between about 0.005 to 0.009 inches in diameter, preferably 0.007 inches in diameter. The length of these bristles, measured from surface 30 of head 14, is about 0.440 inches. The cross-sectional area of each tuft 34 is about 0.0027 square inches. There are between eight and twelve type 34 tufts secured to head 14. As shown in FIG. 6, type 34 tufts are rectangular in shape with rounded ends.

A fourth type of tuft, type 36, is made up of bristles formed of PBT with an abrasive such as kaolin clay particles mixed throughout the PBT. These bristles are between about 0.005 to 0.009 inches in diameter, preferably 0.007 inches in diameter. The length of these bristles, measured from surface 30 of head 14, is about 0.440 inches. The cross-sectional area of each tuft 36 is about 0.0040 square inches. There are between four and six type 36 tufts secured to head 14. As shown in FIG. 6, type 36 tufts are rectangular in shape with rounded ends, and are wider across the head than type 34 tufts.

A fifth and final type of tuft, type 38, is made up of bristles formed of PBT with an abrasive such as kaolin clay particles mixed throughout the PBT. These bristles are between about 0.005 to 0.009 inches in diameter, preferably 0.006 inches in diameter. The length of these bristles, measured from surface 30 of head 14, is about 0.350 inches. The cross-sectional area of each tuft 38 is about 0.0084 square inches. There are between four and six type 38 tufts secured to head 14. As shown in FIG. 6, type 36 tufts are rectangular in shape with rounded ends, and are wider than type 36 tufts.

Based on the cross-sectional areas of the various tufts described above, tuft type 28 has a cross-section which is more than four times as large as any other tuft secured to head 14. Although specific materials were described above from which the bristles of each tuft are made, other materials can be used. As such, any of the bristles attached to head 14 could be made from, for example, PBT with or without an abrasive such as kaolin clay, 6.12 nylon with or without an abrasive, or nylon Indicator™ material with or without an abrasive. Additionally, the bristles within a tuft and between tufts can have varying lengths, diameters, cross-sectional shapes, cross-sectional areas, colors and be made of differing materials.

Figure 4:
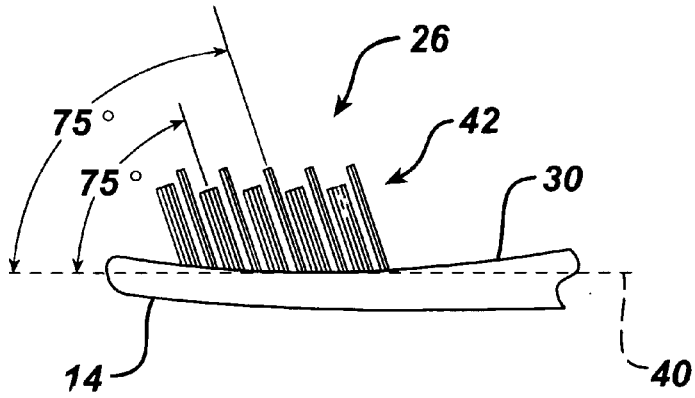
FIGS. 4 and 5 are partial side views of the head and respective portions of the tufts of the toothbrush of FIG. 1.
Figure 5:
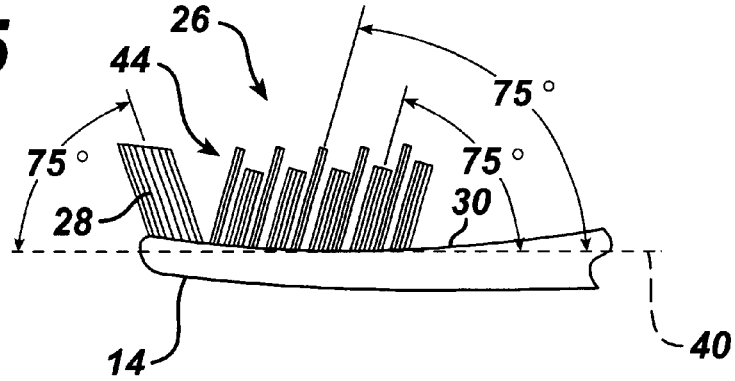

As best seen in FIGS. 2, 4 and 5 and seven, all of the tufts on head 14 are angled either towards direction D or towards the direction opposite of direction D by preferably less than about 81 degrees, more preferably between about 69 degrees to about 81 degrees, and most preferably by about 75 degrees, relative to an imaginary straight line 40 which is tangent to surface 30 of head 14. If surface 30 was flat, rather than curved, then line 40 would be co-planar with surface 30. Two outer rows of tufts 42 are angled towards direction D away from handle 12. An inner row of tufts 44 are angled opposite direction D towards handle 12 with the exception of large tuft 28 which is tilted towards direction D away from handle 12.

Toothbrush 10 can be made by the following process which is generally understood by those skilled in the art. Each of the tufts of bristles are formed by gathering together a desired amount of bristles of a selected material, length and diameter. The tufts are then inserted into apertures in part of a mold of an injection molding machine. An end of the tuft which is or will project into the mold cavity is then melted to join the bristles together in a fused mass or ball at that end of the tuft. The mold part bearing the tufts is then joined with another portion of the mold which together define a cavity used to form main portion 16 of the toothbrush. The fused masses of the tufts are located just within the cavity.

Polypropylene is then injected into the cavity to form portion 16 of toothbrush 10. The polypropylene is then cooled at which point the partially finished toothbrush is moved to a second injection molding station. The cooled, hardened polypropylene secures the fused masses of the tufts to head 14 of the toothbrush. At the second molding station, the partially finished brush is put into a second mold having cavities to form the thumb gripping portion 18, trademark 24 and finger gripping portion 20. A thermoplastic elastomer is then injected into the mold after which the elastomer is cooled and finished toothbrush 10 is removed from the mold. The toothbrush is then packaged.

The invention has been described with reference to a preferred embodiment. However, it will be appreciated that variations and modifications can be effected by a person of ordinary skill in the art without departing from the scope of the invention.

What is claimed is:

1. A toothbrush, comprising:

a handle;

a head extending from the handle; and a plurality of tufts of bristles secured to the head, one of the tufts being secured to the head at a location such that no other tuft is secured to the head at a location which is more distal from the handle than the location where the one tuft is secured to the head, the one tuft being angled by 81 degrees or less relative to an imaginary line which is tangent to or co-planar with a surface of the head through which the one tuft is secured to the head, the one tuft being tilted away from the handle towards a direction along which the head extends from the handle, a second one of the tufts being tilted towards the handle, all of the bristles of a third one of the tufts being angled at an acute angle relative to the imaginary line, the second and third tufts have different cross-sections from each other.

2. The toothbrush of claim 1, wherein the one tuft is angled by between about 69 to about 81 degrees from the imaginary line.

3. The toothbrush of claim 2, wherein the one tuft is angled by about 75 degrees from the imaginary line.

4. The toothbrush of claim 1, wherein the second and third tufts have different lengths from each other when measured from the surface.

5. The toothbrush of claim 4, wherein the second and third tufts differ in length from each other by about 0.090 inches.

6. The toothbrush of claim 1, wherein the cross-sections differ in shape.

7. The toothbrush of claim 1, wherein the cross-sections differ in area.

8. The toothbrush of claim 1, wherein the cross-sectional area of the one tuft is at least eight times as large as the cross-sectional area of the second tuft or any one of the other tufts secured to the head.

9. The toothbrush of claim 1, wherein no other tuft is secured to the head at a location which is as distal from the handle as the location where the one tuft is secured to the head.

10. The toothbrush of claim 1, wherein one or more of the bristles has a characteristic which is different from the other bristles, the characterisitc being selected from the group consiting of length, diameter, cross-sectional area, cross-sectional shape, color, material and combinations thereof.

11. The toothbrush of claim 1, wherein the one tuft has a tuft volume measured from the head surface of between about 0.015 and 0.018 cubic inches.

12. A toothbrush, comprising:

a handle;

a head extending from the handle; and a plurality of tufts of bristles secured to the head, three of the tufts each being at an acute angle relative to an Imaginary line which is tangent to or co-planar with a surface of the head through which the three tufts are secured to the head, the three tufts being angled and aligned substantially toward the same direction, the direction being substantially parallel with the handle, the direction being substantially towards or away from the handle, a first one of the three tufts having a length, a second one of the three tufts being adjacent to the first tuft and having a length shorter than the length of the first tuft, and a third one of the three tufts being adjacent to the first tuft and having a length shorter than the length of the first tuft, a fourth tuft being secured to the head at a location such that no other tuft is secured to the head at a location which is more distal from the handle than the location where the fourth tuft is secured to the head, the cross-sectional area of the fourth tuft being at least four times as large as the cross-sectional area of any other tuft secured to the head.

13. The toothbrush of claim 12, wherein the fourth tuft is angled by between about 69 to about 81 degrees from the imaginary line.

14. The toothbrush of claim 12, wherein the fourth tuft is angled by about 75 degrees from the imaginary line.

15. The toothbrush of claim 12, wherein no other tuft is secured to the head at a location which is as distal from the handle as the location where the fourth tuft is secured to the head.

16. The toothbrush of claim 12, wherein the fourth tuft is angled by about 81 degrees or less relative to the imaginary line and tilted away from the handle towards a general direction from which the head extends from the handle.

17. The toothbrush of claim 12, wherein one or more of the bristles has a characteristic which is different from the other bristles, the characteristic being selected from the group consiting of length, diameter, cross-sectional area, cross-sectional shape, color, material and combinations thereof.

18. The toothbrush of claim 12, wherein the three tufts are angled by between about 69 to about 81 degrees from the imaginary line.

19. The toothbrush of claim 18, wherein the three tufts are angled by about 75 degrees from the imaginary line.

20. A toothbrush, comprising:

a handle;

a head extending from the handle; and three tufts of bristles secured to the head, the tufts each being at an acute angle relative to an imaginary line which is tangent to or co-planar with a surface of the head through which the tufts are secured to the head, two of the three tufts differing in cross-section, the three tufts being angled and aligned substantially toward the same direction, the direction being substantially parallel with the handle, the direction being substantially towards or away from the handle, a first one of the three tufts having a length, a second one of the three tufts being adjacent to the first tuft and having a length shorter than the length of the first tuft, and a third one of the three tufts being adjacent to the first tuft and having a length shorter than the length of the first tuft.

21. The toothbrush of claim 20, wherein two of the three tufts also differ in color.

22. The toothbrush of claim 20, wherein the tufts are angled towards the handle.

23. The toothbrush of claim 20, wherein the tufts are angled away from the handle.

24. The toothbrush of claim 23, further including a fourth tuft which is tilted towards the handle.

25. The toothbrush of claim 24, further including a fifth tuft which is tilted towards the handle.

26. The toothbrush of claim 25, wherein the fourth and fifth tufts differ in length.

27. The toothbrush of claim 25, wherein the fourth and fifth tufts differ in color.

28. The toothbrush of claim 27, wherein the fourth and fifth tufts differ in length.

29. The toothbrush of claim 25, further including a sixth tuft which is tilted away from the handle.

30. The toothbrush of claim 29, further including a seventh tuft which is tilted away from the handle.

31. The toothbrush of claim 30, wherein the sixth and seventh tufts differ in length.

32. The toothbrush of claim 30, wherein the sixth and seventh tufts differ in color.

33. The toothbrush of claim 32, wherein the sixth and seventh tufts differ in length.

34. The toothbrush of claim 24, wherein the fourth and fifth tufts differ in length.

35. A toothbrush, comprising:

a head with a frontal free end and a rearward section;

a handle connected to the head;

tufts of bristles arranged in longitudinal rows on the rearward section of the head, tufts in a first row being tilted in a first direction towards the free end of the head, tufts in a second row being tilted towards a second direction opposite the first direction; and a further tuft of bristles secured to the frontal free end of the head and being tilted towards the first direction, the further tuft having a first length, the tufts on the rearward section of the head either having the first length or a second length, the first length being longer than the second length, each longitudinal row including tufts of bristles of the first and second lengths, adjacent tufts in a longitudinal row alternately having the first and second length.

* * * * *